US005870907A

United States Patent [19]

Cho

[11] Patent Number: 5,870,907

[45] Date of Patent: Feb. 16, 1999

[54] DRUM TYPE CLOTHES WASHER HAVING FLUID TYPE VIBRATION ATTENUATION APPARATUS

[75] Inventor: Min-Su Cho, Suwon, Rep. of Korea

[73] Assignee: Samsung Electronics Co., Ltd., Suwon, Rep. of Korea

[21] Appl. No.: 705,416

[22] Filed: Aug. 29, 1996

[30] Foreign Application Priority Data

Aug. 29, 1995 [KR] Rep. of Korea ..... 1995 22875

[51] Int. Cl.[6] ..... D06F 37/22

[52] U.S. Cl. ..... 68/23.1; 68/140

[58] Field of Search ..... 68/23.1, 23.2, 68/24, 58, 140, 139, 142

[56] References Cited

U.S. PATENT DOCUMENTS

| | | | |
|---|---|---|---|
| 2,549,756 | 4/1951 | Clark | 68/23.2 |
| 2,615,456 | 10/1952 | Galusha | 134/159 |
| 2,872,801 | 2/1959 | Smith | 68/23.2 |
| 2,886,979 | 5/1959 | Baxter | 68/23.2 |
| 2,972,510 | 2/1961 | Buss et al. | 68/23.1 |
| 3,142,641 | 7/1964 | Lachat | 68/23.2 |
| 3,214,946 | 11/1965 | Starr et al. | 68/23.2 |
| 3,235,082 | 2/1966 | Compans | 68/23.2 |
| 3,580,014 | 5/1971 | Mazza | 68/23.1 |
| 3,983,035 | 9/1976 | Areveld et al. | 68/23.2 |
| 4,991,247 | 2/1991 | Castwell et al. | 68/23.2 |
| 5,582,040 | 12/1996 | Khan | 68/23.2 |

*Primary Examiner*—Frankie L. Stinson
*Attorney, Agent, or Firm*—Burns, Doane, Swecker & Mathis, L.L.P.

[57] ABSTRACT

A drum type clothes washing machine includes a housing, an outer tub mounted by springs in the housing, and a washing tub mounted in the outer tub for rotation relative thereto about a horizontal axis. A vibration attenuation apparatus includes a pair of chambers fixed to an underside of the outer tub. The chambers contain a liquid and communicate with one another. A motor drives the washing tub. A pump is also driven by the motor for transferring liquid from one chamber to the other for compensating for a shifting of the axis during rotation of the washing tub.

4 Claims, 3 Drawing Sheets

DRUM TYPE CLOTHES WASHER HAVING FLUID TYPE VIBRATION ATTENUATION APPARATUS

BACKGROUND OF THE INVENTION

1. Field of the Invention

The present invention relates to a vibration attenuation apparatus of a drum type clothes washing machine, and more particularly to a vibration attenuation apparatus of a drum type washing machine.

2. Description of the Prior Art

First of all, a structure and operation of a conventional drum type clothes washing machine will be described with reference to FIG. 1.

As illustrated in FIG. 1, reference numeral 1 is a body or housing for forming an appearance of the conventional drum type washing machine, and the body 1 is provided at an inner side thereof with an outer tub 3 for storing the washing water.

The outer tub 3 is provided therein with a washing tub 5 for storing the laundry, and disposed thereunder is a motor 7 for receiving the electrical power from outside to thereby be driven. The motor 7 is provided at one side thereof with a motor shaft 8. The outer tub 3 is arranged at one side thereof with a belt 11 connected to the motor shaft 8 and to a pulley member 9 mounted on a horizontal axle of the tub 5.

Meanwhile, the outer tub 3 and the body 1 are interconnected by a plurality of buffer springs 13 for performing a buffer action during washing and spin-drying.

The outer tub 3 and the body 1 are also interconnected by a plurality of impact absorbers 15 for absorbing impact by being retracted or expanded during washing and spin-drying processes.

The body 1 is provided at one side of a floor thereof with a vibration attenuation apparatus 17 for attenuating vibration during washing and spin-drying processes.

The outer tub 3 is provided thereunder with a discharge pipe 19 for discharging the washing water after washing and spin-drying steps.

The vibration attenuation apparatus 17 includes first and second fluid chambers 21 and 23 for storing a fluid, and a pump 27 driven by a belt 25 connected to the motor shaft, so that fluid stored in the first and second fluid chambers 21 and 23 can be moved to the left and to the right.

In the conventional drum type washing machine thus constructed, when an operating condition is selected by a manual selection, an electric power is applied and water is supplied to the outer tub 3 and the washing tub 5 by way of water supply means (not shown), and rotation is transmitted to the belt 11 according to drive of the motor 7 to thereby rotate the washing tub 5 clockwise or counterclockwise.

Washing is performed in such way that the laundry articles and the washing water is pulled upwards and dropped by water current control means (not shown) provided in the washing tub 5 as the washing tub 5 is rotated clockwise or counterclockwise.

When the washing is finished, the washing water is discharged through the discharge pipe 19, and when water is supplied again by way of the water supply means, rinsing strokes are performed several times. Then spin-drying strokes are performed and the washing tub 5 is rotated in only one direction to thereby perform the spin-drying.

While the washing and spin-drying strokes are performed, the impact absorbers 15 mounted at the outer tub 3 and the body 1 at the floor thereof become retracted or expanded to absorb the impact or shock, and the plurality of buffer springs 13 serve to buffer vibration by way of a spring force thereof.

Meanwhile, when the motor shaft 8 is rotated counterclockwise, the washing tub 5 is rotated counterclockwise to thereby move center of the washing machine to the left.

At this time, the pump 27 connected to the motor shaft 8 by way of the belt 25 is moved in the same direction to thereby transfer the fluid stored in the first fluid chamber 21 to the second fluid chamber 23, to compensate for the movement of the center of the machine.

Furthermore, when the motor shaft 8 is rotated clockwise, the washing tub 5 is also rotated clockwise to thereby move the center of the washing machine to the right, and the pump 27 transfers fluid from the second fluid chamber 23 to the first fluid chamber 21 to compensate for the movement of the center of the washing machine to the right and to thereby attenuate vibration.

At this time, a heavy member (not shown) disposed under the body 1 prevents the body 1 from being vibrated.

However, there is a problem in the conventional drum washing machine thus constructed, in that an effective vibration attenuation cannot be obtained, and structure thereof gets complicated since a separate belt is used to transfer the power to the motor.

There is another problem in that a heavy member should be disposed underneath the body to attenuate vibration of the body generated as the washing tub is rotated, causing an increase of overall weight of the washing machine.

SUMMARY OF THE INVENTION

Accordingly, the present invention is disclosed to solve the aforementioned problems and it is an object of the present invention to provide a vibration attenuation apparatus which can directly attenuate vibration of a body of the washing machine.

It is another object of the present invention to provide a vibration attenuation apparatus of a drum washing machine which eliminates the need for a separate heavy member to prevent a vibration to thereby enable the weight of the washing machine to be reduced and at the same time, to enable a floor of the body to be usefully utilized.

In accordance with the objects of the present invention, there is provided a vibration attenuation apparatus of a drum washing machine, the apparatus comprising:

a first fluid chamber and a second fluid chamber for storing fluid;

a pump for mutually moving the fluid therebetween in the first and the second fluid chambers according to rotating direction of a washing tub; and a motor for rotating the washing tub and for operating the pump.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Now, the embodiment of the present invention will be described in detail with reference to the accompanying drawings.

Figure 2:
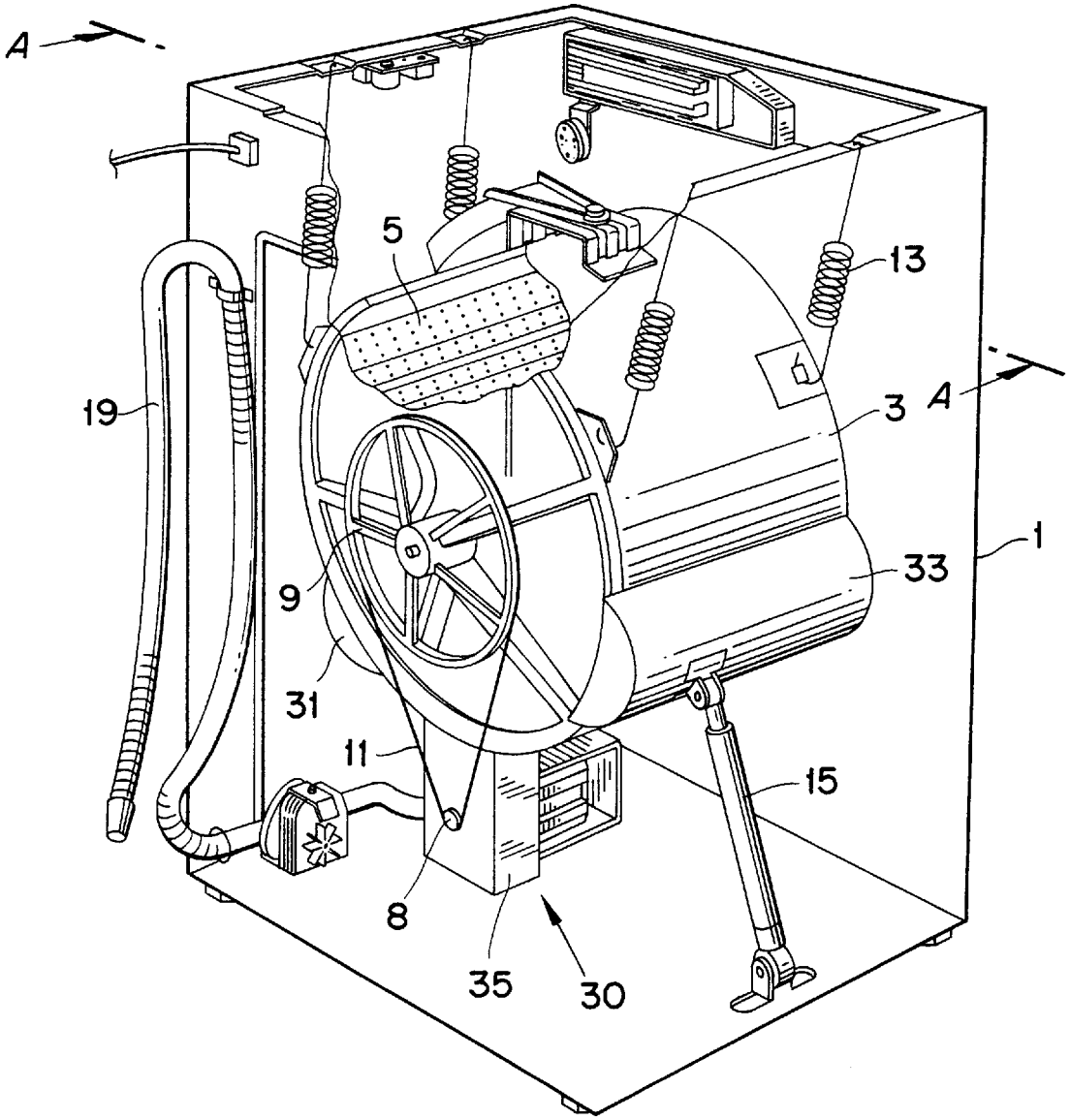
FIG. 2 is an overall perspective view of a drum washing machine mounted with a vibration attenuation apparatus according to an embodiment of the present invention.

FIG. 2 is an overall perspective view of a drum washing machine equipped with a vibration attenuation apparatus according to the embodiment of the present invention.

Figure 1:
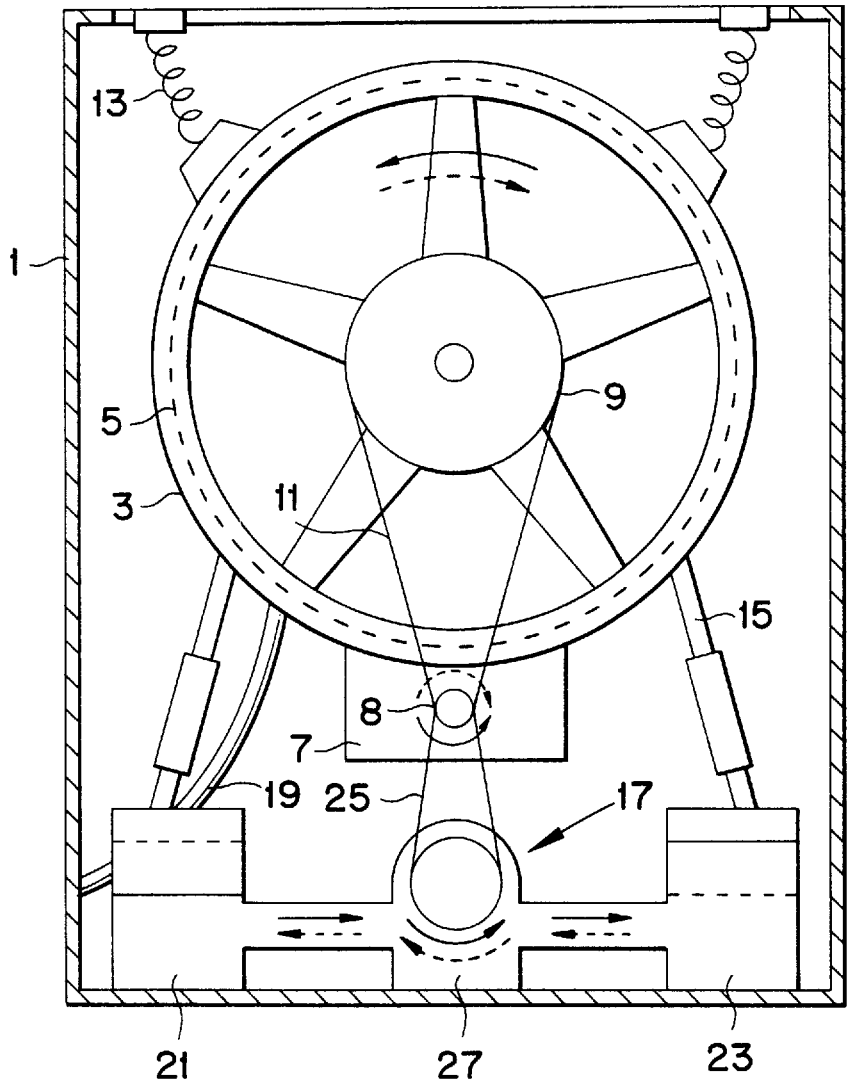
FIG. 1 (PRIOR ART)
FIG. 1 is a sectional view through a conventional drum washing machine.

Throughout the drawings, like reference numerals and symbols as in FIG. 1 are used for designation of like or equivalent parts or portions for simplicity of illustrated and explanation, and a detailed description thereof will be omitted.

As illustrated in FIG. 2, a body or housing 1 of the washing machine is provided therein with an outer tub 3 for storing the washing water. The body 1 and tub 3 together define a support structure. The outer tub 3 is provided therein with a drum-type washing tub 5. The outer tub 3 is provided thereunder with a motor 6 for being driven by electric power. The motor 6 is provided at one end thereof with a motor shaft 8.

Figure 3:
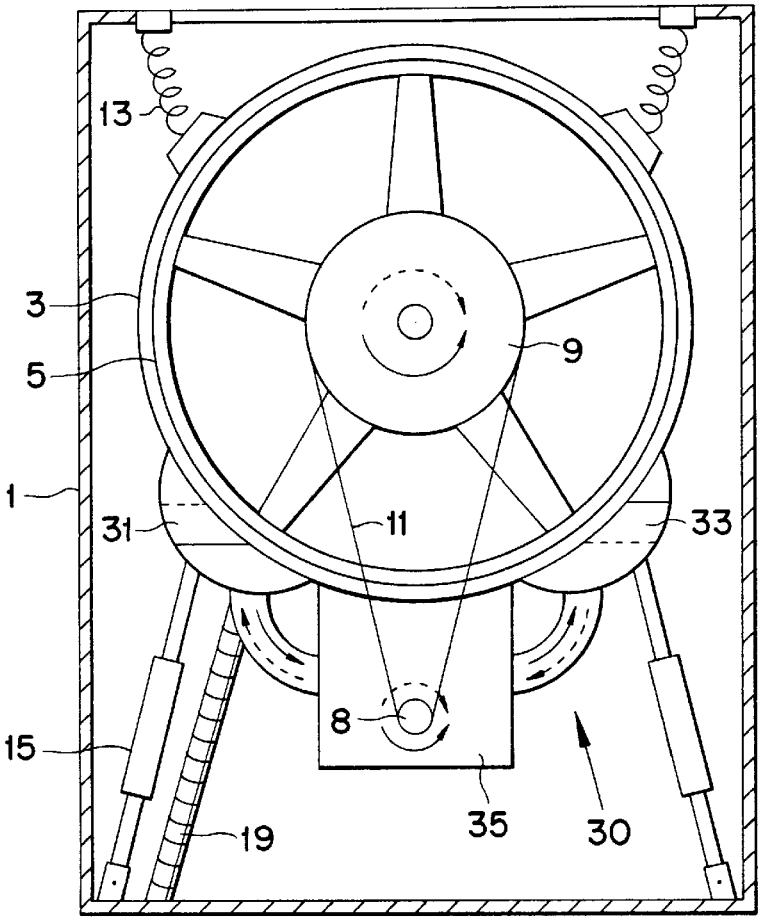
FIG. 3 is a sectional view taken along line 3—3 of FIG. 2.

Meanwhile, the motor shaft 8 and a pulley member 9 on an axle of the tub 5 are interconnected by a belt 11 as illustrated in FIGS. 2 and 3.

The outer tub 5 and the body 1 are interconnected at upper sides thereof by a plurality of buffer springs 13 for extertinge cushioning action during the washing and spin-drying processes.

A lower side of the outer tub 3 and the floor of the body 1 are interconnected by a plurality of impact absorbers 15 for absorbing shock by being retracted or expanded during the washing and spin-drying processes.

The outer tub 3 carries a vibration attenuation apparatus 30 for reducing the vibration generated in the course of washing and spin-drying.

The outer tub 3 is provided thereunder with a discharge pipe 19 for discharging the washing water when the washing and spin-drying strokes are finished.

Figure 4:
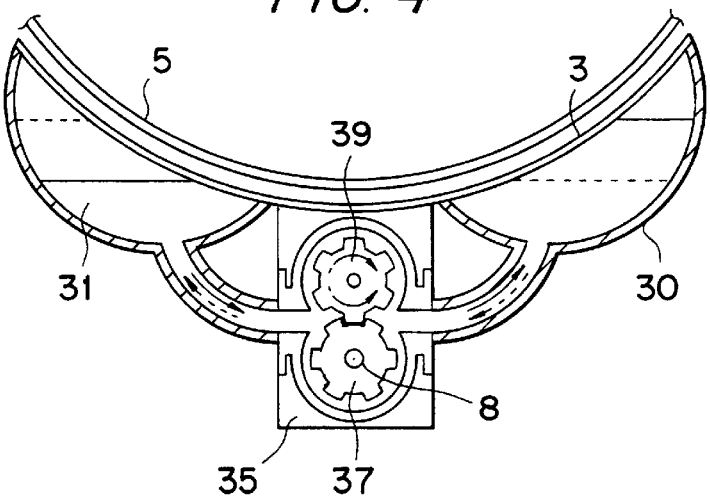
FIG. 4 is a sectional view of principal parts for illustrating a vibration attenuation apparatus of a drum washing machine according to the present invention.

The vibration attenuation apparatus which is a principal part of the present invention includes, as illustrated in FIG. 4, first and second fluid chambers 31 and 33 disposed underneath the outer tub 3 for storing fluid, a pump 35 for transferring the fluid between the first and second fluid chambers 31 and 33, a lower gear 37 disposed in the pump 35 for being rotated the motor shaft 8, and an upper gear 39 meshed with the lower gear 37 to be rotated clockwise or counterclockwise according to the rotation of the lower gear 37.

Next, an operational effect of the vibration attenuation apparatus of a drum type 2 washing machine according to the embodiment of the present invention thus constructed will be described.

First of all, when an operating condition is selected by the manipulating means (not shown), electric power is applied and water is supplied into the washing tub 5 and the outer tub 3 by water supply means (not shown). Rotation is transmitted by the belt 11 according to the activation of the motor 6 to thereby rotate the washing tub 5 clockwise or counterclockwise.

The laundry articles and washing water are pulled upwards and dropped by water current control means (not shown) provided in the washing tub 5, and the washing is performed accordingly.

At this time, the vibration attenuation apparatus 30 mounted underneath the outer tub 3 serves to directly attenuate vibration generated in accordance with the rotation of the washing tub 5 in the outer tub 3 clockwise or counterclockwise.

In other words, as illustrated in FIG. 3, as the motor shaft 8 is rotated counterclockwise, the washing tub 5 is rotated counterclockwise, and when center of the washing machine is eccentrically moved to the left as the result of mis rotation, the lower gear 37 disposed on the motor shaft 8 is rotated in the same counterclockwise direction as the motor shaft 8, and the upper gear 39 meshed with the lower gear 37 is then rotated clockwise to move the fluid stored in the first fluid chamber 31 to the second fluid chamber 33 and to thereby cause the fluid to maintain a fluid level (shown by solid lines 31A in FIG. 4) compensating for the eccentric center.

Furthermore, when the center of the washing machine is eccentrically moved to the right according to clockwise rotation of the motor shaft 8, the lower gear 37 is rotated clockwise, and the upper gear 39 meshed with the lower gear 37 is then rotated counterclockwise to move the fluid stored in the second fluid chamber 33 to the first fluid chamber 31 to thereby cause the level thereof (shown by dotted lines 31B) to compensate for the eccentric center.

When the washing is finished, the washing water is discharged through the discharge pipe 19 and when water is again supplied by the water supply means, rinsing strokes are performed several times. Then, flow changes to spin-drying strokes where the washing tub 5 is rotated in only one direction for spin-drying.

At this time, the lower gear 37 and the upper gear 39 disposed in the pump 35 are rotated as in the washing strokes to thereby move the fluid for correction of the center.

Meanwhile, the impact absorber 15 mounted at the floor of the body 1 and at the lower area of the outer tub 3 is retracted or expanded during the washing and spin-drying strokes as mentioned above, to thereby absorb the shock, and the plurality of buffer springs disposed at one side of the body 1 and at the upper side of the outer tub 3 serve to cushion the vibration according to adjustment of the spring force thereof.

As is apparent from the foregoing, there is an advantage in the vibration attenuation apparatus of a drum type washing machine according to the embodiment of the present invention, in that the vibration attenuation apparatus attached underneath the outer tub of the washing machine serves to directly reduce the vibration generated by the rotation of the washing tub disposed in the outer tub, thereby preventing the vibration at the body.

There is another advantage in that a heavy member (vibration preventive member) provided at the floor of the body to prevent vibration thereof at the conventional washing machine is not used and the same effect of attenuating the vibration can be obtained only by provision of a small-sized vibration attenuation apparatus, thereby reducing the manufacturing cost.

The foregoing description of the preferred embodiment has been presented for the purpose of illustration and description. It is not intended to limit the scope of this invention. Many modifications and variations are possible in light of above teaching. It is intended that the scope of the invention be defined by the claims.

What is claimed is:

1. A drum-type clothes washing machine comprising:

an outer tub for receiving washing water;

a washing tub disposed within the outer tub for rotation relative thereto about a substantially horizontal axis for washing and spin-drying laundry contained in the washing tub; and a vibration attenuation apparatus comprising:

a first and second horizontally-spaced fluid chambers fixed to an underside of the outer tub, the first and second fluid chambers containing a liquid and communicating with one another, a rotary pump fixed to the underside of the outer tub between the first and second chambers for moving liquid from one of the chambers to the other chamber, to compensate for a shifting of the axis during rotation of the washing, and a drive mechanism fixed to the underside of the outer tub for rotating the washing drum and the pump simultaneously.

2. The washing machine according to claim 1, wherein the drive mechanism comprises a motor having a rotary axis, the pump comprising a pair of meshed gears immersed in the liquid between the chambers, one of the gears being coaxial with the rotary axis and driven by the motor, and the other gear being driven by the one gear.

3. The washing machine according to claim 2, wherein the two gears are disposed one above the other.

4. The washing machine according to claim 1, further including a housing in which the outer tub is disposed, the outer tub spaced above a floor of the housing, and springs connecting the outer tub to the housing.

* * * * *